US008663522B2

(12) United States Patent
Orf et al.

(10) Patent No.: US 8,663,522 B2
(45) Date of Patent: Mar. 4, 2014

(54) FIBER DRAW SYNTHESIS

(75) Inventors: Nicholas D. Orf, Somerville, MA (US); Sylvain Danto, Clemson, SC (US); Ofer Shapira, Cambridge, MA (US); Fabien Sorin, Paris (FR); Yoel Fink, Brookline, MA (US); John D. Joannopoulos, Belmont, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 240 days.

(21) Appl. No.: 13/271,334

(22) Filed: Oct. 12, 2011

(65) Prior Publication Data

US 2012/0267820 A1 Oct. 25, 2012

Related U.S. Application Data

(60) Provisional application No. 61/443,899, filed on Feb. 17, 2011.

(51) Int. Cl.
*C01B 19/00* (2006.01)
*D02J 1/22* (2006.01)

(52) U.S. Cl.
USPC ..... 264/176.1; 423/508

(58) Field of Classification Search
USPC ..... 264/176.1, 210.8, 211; 423/508, 509
See application file for complete search history.

(56) References Cited

U.S. PATENT DOCUMENTS

| | | | | |
|---|---|---|---|---|
| 5,501,746 | A * | 3/1996 | Egawa et al. | 148/98 |
| 7,833,506 | B2 * | 11/2010 | Rauscher et al. | 423/509 |
| 2004/0062499 | A1 * | 4/2004 | Gasca et al. | 385/125 |
| 2011/0098199 | A1 * | 4/2011 | Oleschuk et al. | 506/13 |

FOREIGN PATENT DOCUMENTS

| | | | |
|---|---|---|---|
| WO | WO-8912030 A1 * | 12/1989 | 505/951 |

OTHER PUBLICATIONS

Russell P (2003) Photonic crystal fibers. Science 299(5605):358-362.

Abouraddy AF, et al. (2007) Towards multimaterial multifunctional fibres that see, hear, sense and communicate. Nature Materials 6(5):336-347.

Cerqueira SA (2010) Recent progress and novel applications of photonic crystal fibers. Rep. Prog. Phys. 73(2):21.

Tyagi HK, Schmidt MA, Sempere LP, & Russell PSJ (2008) Optcal properties of photonic crystal fiber with integral micron-sized Ge wire. Optics Express 16(22):17227-17236.

Shapira O, et al. (2006) Surface-emitting fiber lasers. Optics Express 14(9):3929-3935.

Jackson BR, Sazio PJA, & Badding JV (2008) Single-crystal semiconductor wires integrated into microstructured optical fibers. Advanced Materials 20(6):1135-1140.

Sazio PJA, et al. (2006) Microstructured optical fibers as high-pressure microfluidic reactors. Science 311 (5767):1583-1586.

(Continued)

*Primary Examiner* — Leo B Tentoni
(74) *Attorney, Agent, or Firm* — Sam Pasternack; MIT Technology Licensing Office

(57) ABSTRACT

Fiber draw synthesis process. The process includes arranging reactants in the solid state in proximate domains within a fiber preform. The preform is fluidized at a temperature below the melting temperature of the reactants. The fluidized preform is drawn into a fiber thereby bringing the reagents in the proximate domains into intimate contact with one another resulting in a chemical reaction between the reactants thereby synthesizing a compound within the fiber. The reactants may be dissolved or mixed in a host material within the preform. In a preferred embodiment, the reactants are selenium and zinc.

4 Claims, 6 Drawing Sheets

(56) References Cited

OTHER PUBLICATIONS

O'Connor B, Pipe KP, & Shtein M (2008) Fiber based organic photovoltaic devices. Applied Physics Letters 92 (19):193306-1-193306-3.
Liu JW, Namboothiry MAG, & Carroll DL (2007) Fiber-based architectures for organic photovoltaics. Applied Physics Letters 90(6) 063501-1-063501-3.
Liu JW, Namboothiry MAG, & Carroll DL (2007) Optical geometries for fiber-based organic photovoltaics. Applied Physics Letters 90(13) 133515-1-133515-3.
Lee MR, et al. (2009) Solar Power Wires Based on Organic Photovoltaic Materials. Science 324(5924):232-235.
Danto S, et al. (2010) Fiber Field-Effect Device Via in Situ Channel Crystallization. Advanced Materals 22 (37):4162-4166.
Bayindir M, et al. (2005) Integrated fibres for self-monitored optical transport. Nature Materials 4(11):820-825.
Sorin F, et al. (2007) Multimaterial photodetecting fibers: a geometric and structural study. Advanced Materials 19 (22):3872-3877.
Williams RH & Polanco JI (1974) Electronic-Structure of Chalcogenide Solids—Photoemission Study of Ordered and Disordered Selenium and Tellurium. Journal of Physics C-Solid State Physics 7(15):2745-2759.
Orf N, Baikie I, Shapira O, & Fink Y (2009) Work Function Engineering in Low Temperature Alloys. Applied Physics Letters 94:1135041-113504-3.
Champness CH & Chan A (1985) Relation Between Barrier Height and Work Function in Contacts to Selenium. J. Appl. Phys. 57(10):4823-4825.
Sommerhalter C, Matthes TW, Glatzel T, Jager-Waldau A, & Lux-Steiner MC (1999) High-sensitivity quantitative Kelvin probe microscopy by noncontact ultra-high-vacuum atomic force microscopy. Applied Physics Letters 75(2):286-288.
Seah MP, Clifford CA, Green FM, & Gilmore IS (2005) An accurate semi-empirical equation for sputtering yields I: for argon ions. Surface and Interface Analysis 37(51):444-458.
Schlaf R, Pettenkofer C, & Jaegermann W (1999) Band lineup of a SnS2/SnSe2/SnS2 semiconductor quantum well structure prepared by van der Waals epitaxy. J. Appl. Phys. 85(9):6550-6556.
Bennouna A, Priol M, & Seignac A (1988) Experimental density of states of tin selenide measurement on thin-films. Thin Solid Films 164:69-73.
Chiang TC & Himpsel FJ (2006) ZnSe. Electronic Structure of Solids: Photoemission Spectra and Related Data, Landolt-Bornstein Group III, eds Goldmann A & Koch EE (Springer Verlang, New York), vol. 23a, pp. 81-84.
Nagata K, Ishibashi K, & Miyamoto Y (1981) Raman and Infrared-Spectra of Rhombohedral Selenium. Japanese Journal of Applied Physics 20(3):463-469.
Taylor W (1967) Raman Spectra of Cubic Zinc Selenide and Telluride. Physics Letters A 24(10):556-558.
Gupta P, Bhattacharyya D, Chaudhuri S, & Pal AK (1992) Preparation and Characterization of Polycrystalline Znsxse 1-X Films Prepared by a 2-Zone Hot Wall Technique. Thin Solid Films 221(1-2):154-159.
Ebina A, Fukunaga E, & Takahash.T (1974) Variation with Composition of E0 and E0+ Delta-0 Gaps in ZnSXSe1-X Alloys. Physical Review B 10(6):2495-2500.
Kale RB & Lokhande CD (2004) Room Temperature deposition of ZnSe thin films by successive ionic layer adsorption and reaction (SILAR) method. Mater. Res. Bull. 39(12):1829-1839.
Zhang S-L & Ostling M (2003) Metal Silicides in CMOS Technology: Past, Present, and Future Trends. Critical Reviews in Solid State and Materials Sciences 28(1):1-129.

* cited by examiner

FIBER DRAW SYNTHESIS

This application claims priority to Provisional Application Ser. No. 61/443,899, filed Feb. 17, 2011, the contents of which are incorporated herein by reference.

This invention was made with government support under Grant No. DMR0819762 awarded by the National Science Foundation and under Grant No. W911NF-07-D-004 awarded by the Army Research Office. The government has certain rights in the invention.

BACKGROUND OF THE INVENTION

This invention relates to thermal fiber drawing and more particularly to a thermal fiber drawing process adapted to synthesize a chemical compound in situ that has a melting temperature exceeding the draw temperature.

Thermal fiber drawing is a process in which a macrostructured preform is heated and drawn into extended lengths of microstructured fiber. New methods of increasing both the structural complexity of fibers and number of materials compatible with the drawing process are substantially expanding the functionality of photonic crystal and semiconductor device fibers (1-3). The numbers in parentheses refer to the references listed herein. The contents of all of these references are incorporated herein by reference. The drawing process, however, has always been limited to materials that flow at the draw temperature. Many have tried to avoid this limitation by depositing desired materials inside (4-7) or onto the surface (8-11) of a previously drawn fiber. These post-drawing processes, do not take advantage of the scaling associated with fiber drawing, are limited in their architectural complexity and the length over which uniform structures can be produced.

It is thus an object of the present invention to overcome the requirement that the constituent materials be fluid (high or low viscosity) at the drawing temperature.

SUMMARY OF THE INVENTION

The fiber draw synthesis process of the invention includes arranging reactants in the solid state in proximate domains within a fiber preform. The preform is fluidized at a temperature below the melting temperature of the reactants. The fluidized preform is drawn into a fiber thereby bringing the reactants in the proximate domains into intimate contact with one another resulting in a chemical reaction between the reactants thereby synthesizing a compound within the fiber. In a preferred embodiment, the reactants may be dissolved or mixed in a host material within the preform. Suitable reactants in this embodiment are selenium and zinc. The preform may include slots for containing at least one of the reactants. The invention is capable of synthesizing compounds such as ZnS, ZnSe, ZnTe, PbS, PbSe, PbTe, $In_2Se_3$, InSe, $CuInSe_2$, $Bi_2Se_3$, InAs, InGaAs, and Si(x)Ge(1-x). This list is merely exemplary and not limiting.

DESCRIPTION OF THE PREFERRED EMBODIMENT

According to an embodiment of the invention, process precursors, at least one of which may be dissolved in a host material, are arranged in domains near each other in a macroscopic preform. During thermal drawing the reactants come into contact and react to precipitate a new compound. By careful selection of the preform geometry and reactants, the product imparts significant new functionality to the final fiber. To demonstrate the exciting potential of this new fiber draw synthesis method, a fiber polymer preform containing a thin selenium-sulfur layer next to metallic tin-zinc wires was constructed and thermally co-drawn into a fiber consisting of electrically contacted crystalline ZnSe domains of sub 100 nm scales at the interface between the metallic domains and selenium layer. The formation of the interface compound is the basis for an electronic heterostructure and the first thermally drawn fiber device exhibiting rectifying behavior. The ability to introduce an entire class of materials to the fiber drawing process while maintaining precise and arbitrary geometries should lead to substantial advances in the form and function of all fibers.

Figure 1:
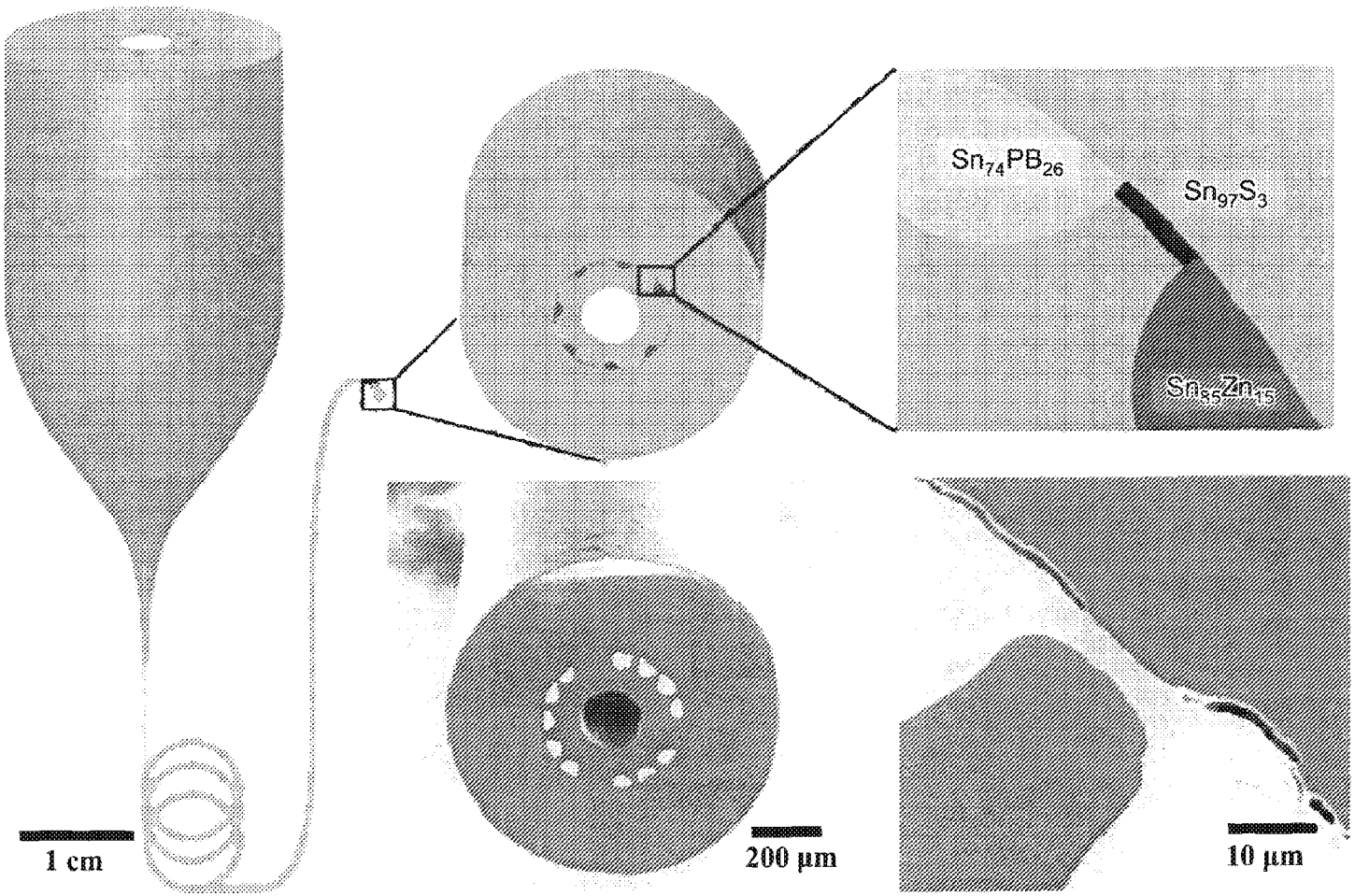
FIG. 1 is a schematic illustration of a structured preform drawn into a fiber along with SEM micrographs of actual fiber and magnification of a single metal/semiconductor/metal device.

A fiber preform consisting of metallic $Sn_{74}Pb_{26}$ and $Sn_{85}Zn_{15}$ wires placed within an amorphous polymer cladding and spanned by a thin film of $Se_{97}S_3$ was constructed and drawn into an extended fiber (schematic drawings and SEM micrographs of the preform and fiber are shown in FIG. 1). The metal electrodes were placed in an alternating fashion such that each $Sn_{74}Pb_{26}/Se_{97}S_3/Sn_{55}Zn_{15}$ combination forms an independently addressable electronic device. Neither the elemental selenium nor zinc reactants are liquid at the drawing temperature and thus incompatible with thermal drawing. However, the melting temperature of both reactants can be depressed by alloying with either sulfur (in the case selenium) or tin (for the zinc reactant). Upon exiting the drawing furnace the selenium alloy is quenched into the amorphous state, but it easily devitrifies to the equilibrium crystalline phase when annealed for one hour at 150° C. (12). The distance between the metal electrodes in a single fiber device is approximately 15 μm, an order-of-magnitude smaller than previous composite device fibers, suggesting that significant device miniaturization and conconmitant increases in device performance and density are possible in future fiber devices (13).

Figure 2A:
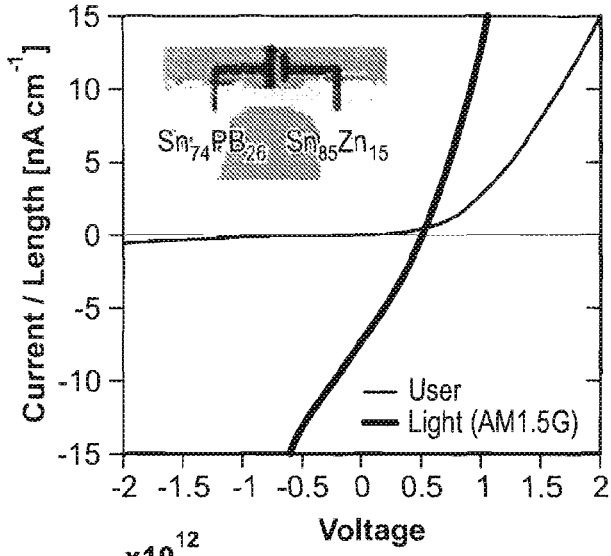
FIG. 2A is a graph showing current per length for distributed photodiode in the dark and under illumination from a simulated AM1.5G source.
Figure 2B:
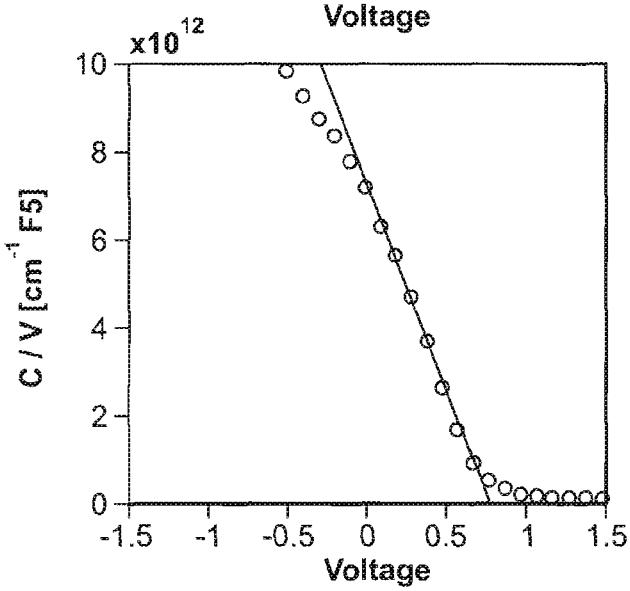
FIG. 2B is a graph showing inverse square of capacitance as a function of applied voltage that reveals a junction built-in voltage of 0.8V.
Figure 2C:
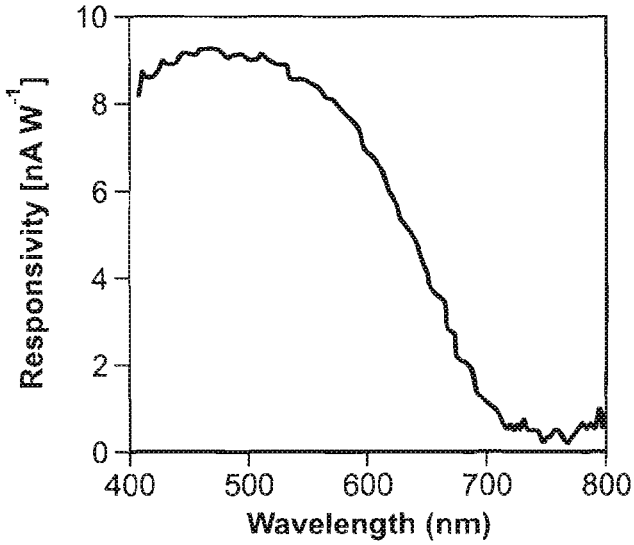
FIG. 2C is a graph showing responsivity as a function of wavelength.

The fiber diode optoelectronic properties are detailed in FIG. 2. The current-voltage characteristics per unit fiber length as a function of voltage both in the dark and under illumination from an AM1.5G solar source is given in FIG. 2A. The $Sn_{74}Pb_{26}$ electrode is biased positive with respect to the $Sn_{85}Zn_{15}$ electrode in the forward direction (inset FIG. 2A). Rectifying behavior is clearly evident in the dark, the magnitude of which is limited by the device series resistance arising from the lateral photodiode geometry. A short-circuit current and open-circuit voltage (0.5 V) develops under illumination, demonstrating the existence of an internal electric field and suggesting future application as a distributed photovoltaic device. A plot of the inverse square capacitance versus applied bias reveals a built-in voltage of about 0.8 V (FIG. 2B). The sign of the applied bias in I-V and C-V measurements suggests that the $Se_{97}S_3/Sn_{74}Pb_{26}$ junction behaves ohmically and the $Se_{97}S_3/Sn_{85}Zn_{15}$ is rectifying. The spectral responsivity shown in FIG. 2C under reverse bias (−2 V) shows maximum response at 460 nm (corresponding to an external quantum efficiency of 2%) and a trail off at around 650 nm, consistent with a selenium bandgap of 1.9 eV. This fiber diode structure represents a major improvement over previous thermally drawn photoconductor fiber devices. In addition to the newly observed rectification, the noise-equivalent-power (NEP) of this structure is a thousand times smaller than previous multimaterial thin-film photoconductor devices at 4.7 pW-$Hz^{0.5}$ (14).

The fact that the I-V and C-V characteristics suggest the metal-semiconductor-metal fiber device is single sided, i.e. composed of one Ohmic and one blocking barrier, seems counterintuitive because of the large work function difference between the semiconductor (15) and metals (16) and the fact that selenium is known to readily form rectifying barriers when contacted to metals in planar devices (17). Indeed in our own control experiments, thermally deposited selenium devices readily formed rectifying contacts, but until now all fiber devices behaved Ohmically. Additional information may be found in the supplemental information contained in N D Orf, O Shapira, F Sorin, S Danto, M A Baldo, J D Joannopoulos, Y Fink, (2011). Fiber Draw Synthesis. Proceedings of the National Academy of Sciences of the United States of America. vol 108, no 12, pp 4743-4747. The contents of this paper are incorporated herein by reference in their entirety. The disparity in the electrical behavior between the planar and fiber devices is due to the different processing methods. While fiber devices experience long periods of time at elevated temperatures where molecular diffusivity is high during preform fabrication and fiber drawing, the thermal evaporation techniques used to fabricate the planar devices are essentially room temperature processes. As the range in work function and elemental composition of the control planar devices spans and includes that of the fiber devices, it is clear that the electronic behavior of fiber devices is not controlled by work function difference. In fact, Kelvin Probe Force Microscopy (KPFM), Energy Dispersive Spectroscopy (EDS) compositional analysis, and Raman spectroscopy provide direct evidence of the formation of a ZnSe compound at the interface between $Se_{97}S_3$ and $Sn_{85}Zn_{15}$, and it is this interface compound that distinguishes the rectifying junction from previous metal-semiconductor-metal fiber devices.

Figure 3:
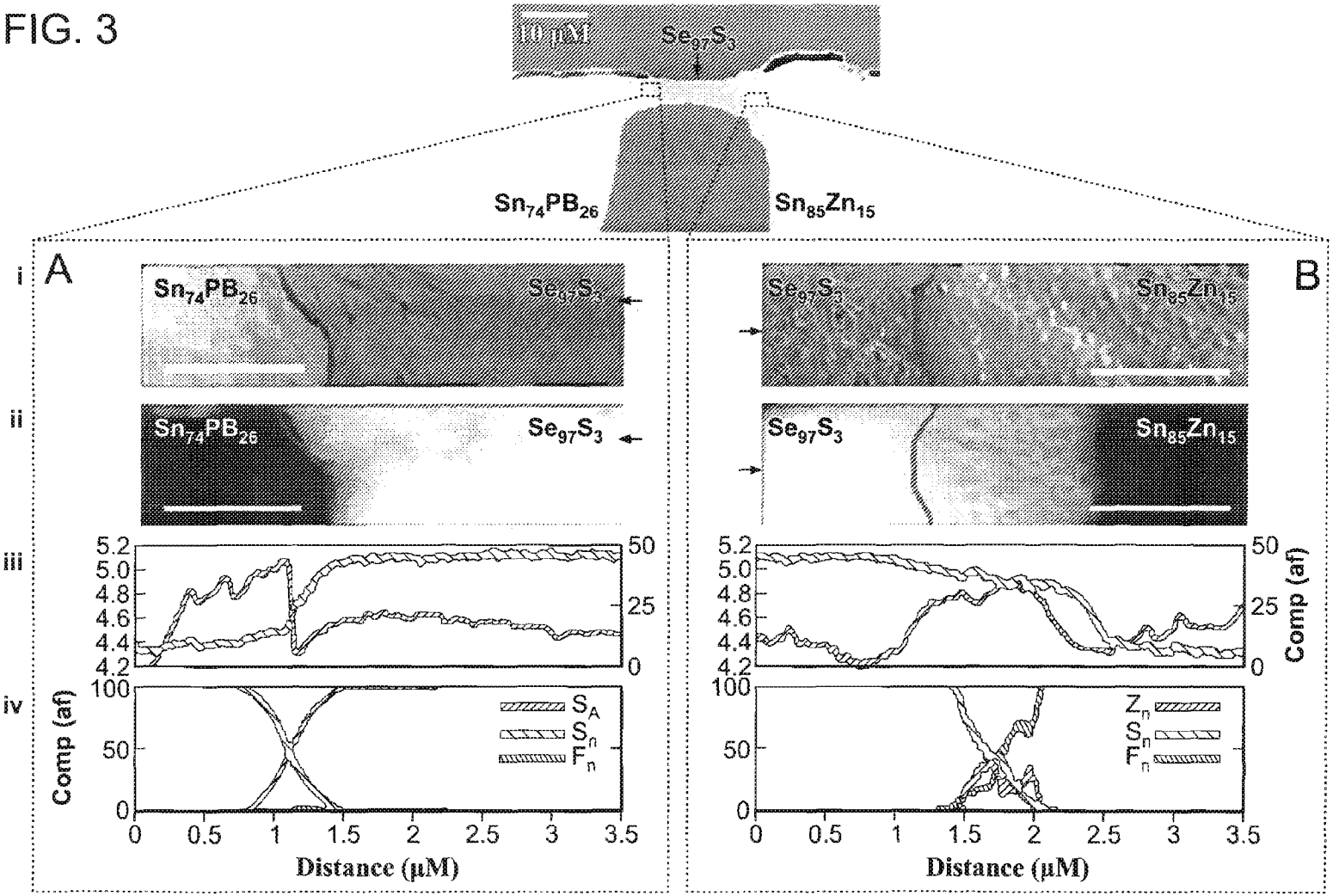
FIG. 3 includes micrographs and graphs showing surface potential and chemical composition of $Se_{97}S_3/Sn_{74}Pb_{26}$ (panel A) and $Se_{97}S_3/Sn_{85}Zn_{15}$ (panel B) junctions.

The spatial variation in surface potential was measured by KPFM (18) and compared with compositional measurements performed by EDS. FIG. 3 presents the KPFM measurements (i-iii) along with SEM-based EDS linescans of similar junctions (iv). KPFM measured topography (i) and work function maps (ii) are shown as well as representative line scans (iii). Changes in height at interfaces arise from differences in sputter rates of the metals and semiconductor (19). A sharp change in both topography and work function can be seen at the $Sn_{74}Pb_{26}/Se_{97}S_3$ metallurgical interface (panel A). The KPFM map and line scan shows the potential change occurs over a 400 nm region at this interface. The SEM EDS measurements reveal notable diffusion of tin and selenium across the interface as well as a small increase in the concentration of lead at the interface. In contrast, the band bending extends over 1 μm at the $Se_{97}S_3/Sn_{85}Zn_{15}$ interface (panel B), beginning with an abrupt change in contact potential at the 2.5 μm mark and followed by a more gradual change. The topography map, however, reveals the apparent metallurgical $Se_{97}S_3/Sn_{85}Zn_{15}$ junction does not coincide with this change in potential but rather occurs at the 1.1 μm mark. SEM EDS line scans show a large increase in zinc concentration at the metallurgical interface. Additional high-resolution scanning TEM EDS measurements of mixed $Se_{97}S_3/Sn_{85}Zn_{15}$ interfaces generated under the same drawing conditions are given in the PNAS paper mentioned above. These measurements show the zinc-containing regions coincide with the selenium-sulfur regions rather than the tin-containing regions even though zinc was initially separate from the sulfur-selenium regions prior to drawing. Furthermore, several point scans show zinc and selenium appearing in a one-to-one ratio.

The combination of the EDS and KPFM data suggest that the electronic behavior at the metal/semiconductor interfaces in the drawn fiber devices is guided by diffusion or compound formation between the metal and semiconductor components. The $Se_{97}S_3/Sn_{74}Pb_{26}$ junction behaves Ohmically despite the large potential drop observed on the $Se_{97}S_3$ side of the junction by KPFM. EDS demonstrates that this interface is diffuse. Indeed the formation of a diffuse interface is a classic method of creating Ohmic contacts between metals and semiconductors (20). The $Se_{97}S_3/Sn_{85}Zn_{15}$ interface is more interesting. A potential gradient across the region in panel B between 1.1 and 2.5 μm is clearly visible; but it does not have the same topography as the selenium semiconductor, and in fact appears as though it has a similar topography to the metal. As band bending cannot occur in high carrier density metals, this area must instead consist of a new semiconductor. If this potential change were due to only interface doping of the semiconductor, the bending would originate at the metal/semiconductor interface and extend only into the semiconductor, as is the case for the $Se_{97}S_3/Sn_{74}Pb_{26}$ junction in panel A. Based on the elements present at the interface, this compound can only be composed of some combination of SnSe, $SnSe_2$ or ZnSe. The coincidence of zinc and selenium in the EDS measurements suggest that the compound is likely ZnSe-based. Indeed, rectifying behavior cannot be controlled by SnSe or $SnSe_2$ because the small potential barrier that would develop between selenium ($E_g$=1.9 eV, I.P.=5.9 eV (17, 21)) and these compounds ($SnSe_2$: $E_g$=1.0 eV, ionization potential=6.1 eV (22), SnSe: $E_g$=0.9 eV (23), I.P.=5.6 eV (24)) cannot explain the built-in potential of 0.8 V determined by both C-V and KPFM measurements. Furthermore there were no signs of this compound formation at the $Se_{97}S_3/Sn_{74}Pb_{26}$ interface even though SnSe and $SnSe_2$ would be just as likely to form at either interface due to the equally high concentration of tin and selenium at both junctions. A large bandgap semiconductor such as zinc selenide ($E_g$=2.7 eV, I.P.=6.8 eV) (25) would, however, form a barrier to hole conduction and explain the rectifying behavior. Additional macroscopic X-ray diffraction (XRD) measurements performed on zinc pieces incubated in molten selenium at the fiber drawing temperature (260° C.) confirm that crystalline ZnSe can form at the drawing temperature.

Figures 4A, 4B, 4C:
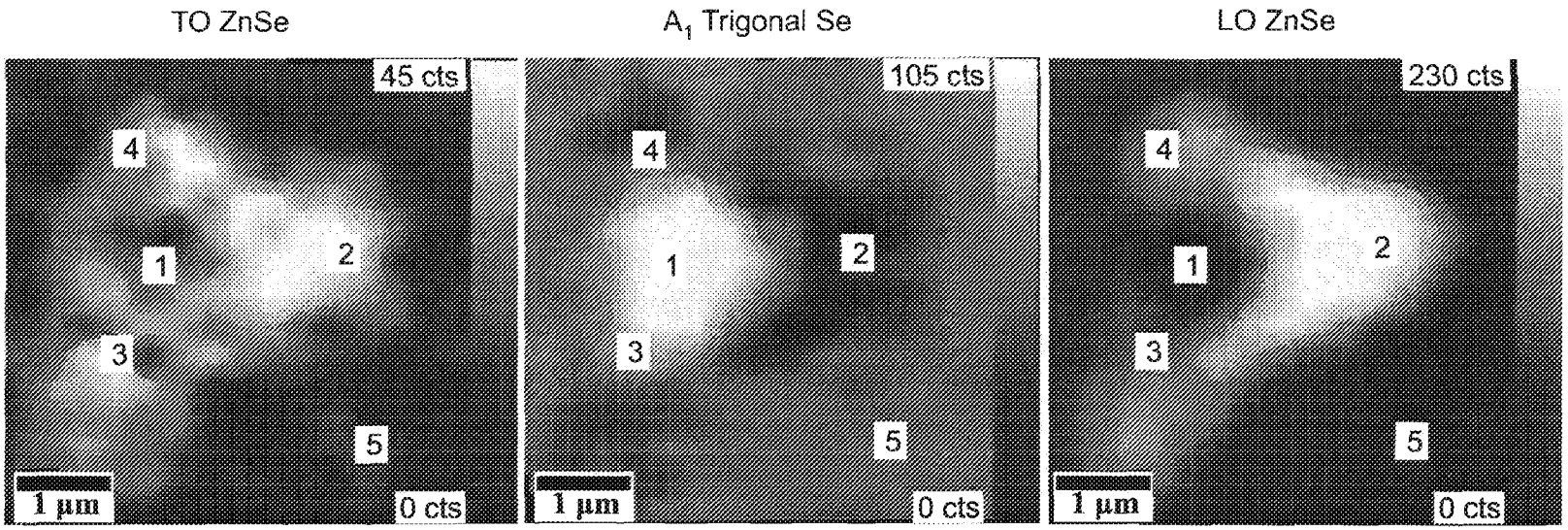
FIGS. 4A-C are Raman images obtained by integration of the spectral range 200-215, 230-245, and 248-263 $cm^{-1}$ corresponding to the TO ZnSe (207 $cm^{-1}$), $A_1$ bond stretching of trigonal Se(238 $cm^{-1}$), and LO ZnSe mode (252 $cm^{-1}$) respectively.
Figure 4D:
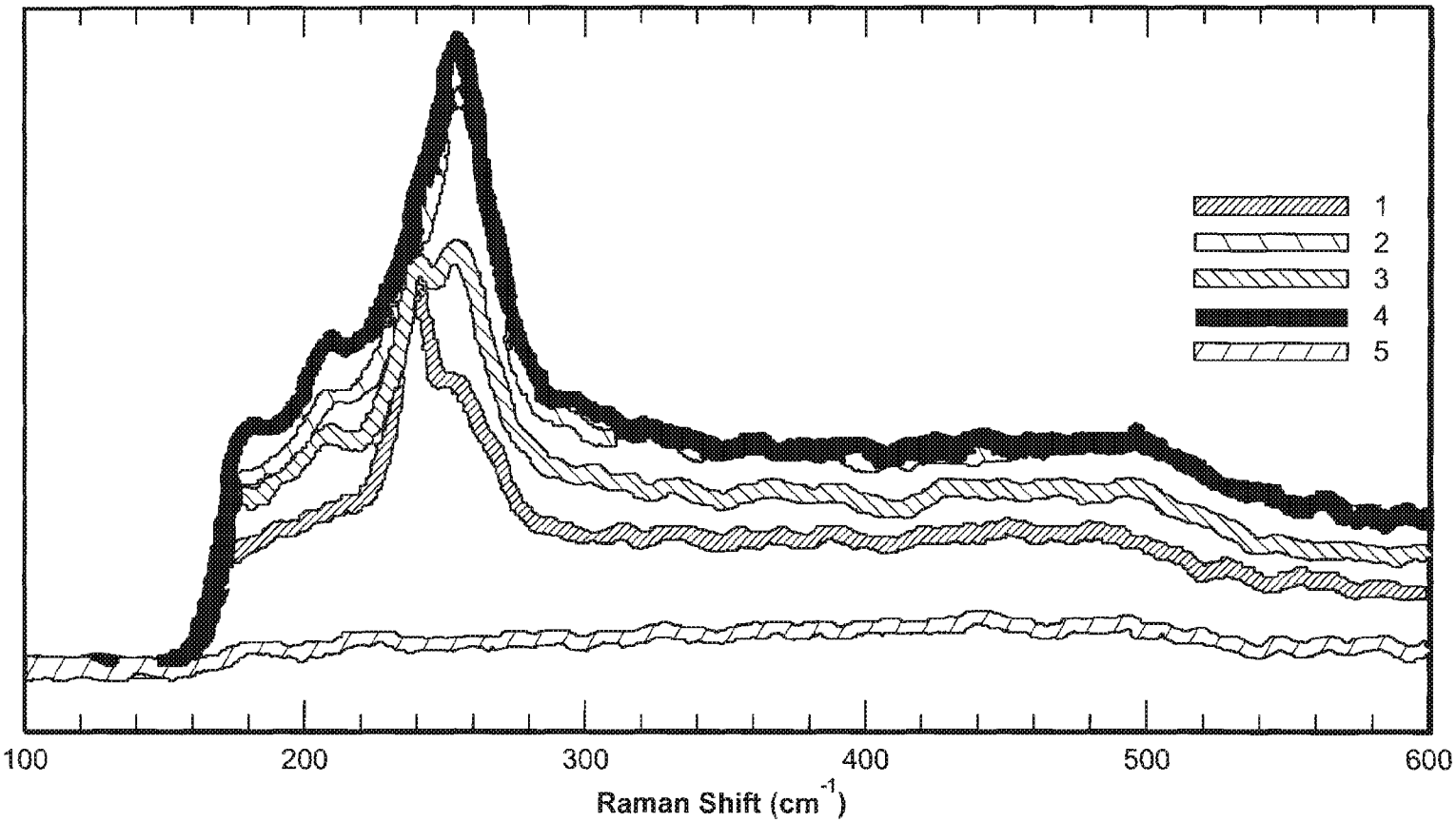
FIG. 4D shows Raman spectra recorded at locations 1-5 in FIGS. 4A-C. Location 1 corresponds to the $Se_{97}S_3$ region. Locations 2-4 correspond to the ZnSe interfacial region. Location 5 corresponds to the $Sn_{85}Zn_{15}$ matrix.

Scanning confocal Raman microscopy performed on a drawn fiber provides direct evidence of ZnSe compound formation inside the fiber. Raman images of a small $Se_{97}S_3$ region that became mixed within the larger $Sn_{85}Zn_{15}$ metal matrix during fiber drawing are shown in FIG. 4. This area highlights the existence of an interfacial compound completely encompassing the $Se_{97}S_3$ area. FIGS. 4A-C show intensity maps obtained by integrating the spectral ranges 200-215, 230-245, and 248-263 $cm^{-1}$, corresponding to the three discrete peaks visible in the Raman spectra at 207, 238, and 252 $cm^{-1}$, respectively. FIG. 4D shows individual Raman spectra at 5 locations within the 5×5 μm scan area. The high intensity peak observed at location 1 (238 $cm^{-1}$) corresponds to the $A_1$ bond-stretching mode of trigonal selenium, the most thermodynamically stable of selenium allotropes (26), while the peaks at 207 and 252 $cm^{-1}$ clearly seen in the spectra taken at locations 2, 3, and 4 correspond to the TO and LO modes of ZnSe, respectively (27). Location 5 in FIG. 4 corresponds to the $Sn_{85}Zn_{15}$ matrix, from which no Raman signal was observed. The broadband signal observed between approximately 160 and 550 $cm^{-1}$ is due to semiconductor fluorescence. Several shoulders visible in the Raman spectra in FIG. 4D may imply the presence of ZnSe in $Se_{97}S_3$ and vice versa. While this may indicate mixing of the selenium and ZnSe phases, these shoulders most likely appear because the semiconductor domains are on the order of microscope resolution. Indeed, the presence of substantial $Se_{97}S_3$ within ZnSe would result in electrical short-circuiting not seen in electronic characterization. Taken together, FIG. 4 clearly shows the presence of an interfacial region between the $Sn_{85}Zn_{15}$ matrix and $Se_{97}S_3$ particle, and this interfacial region is composed primarily of ZnSe. This result is consistent with the KPFM measurements, which also found the existence of an interfacial compound between $Sn_{85}Zn_{15}$ and $Se_{97}S_3$.

Figure 5:
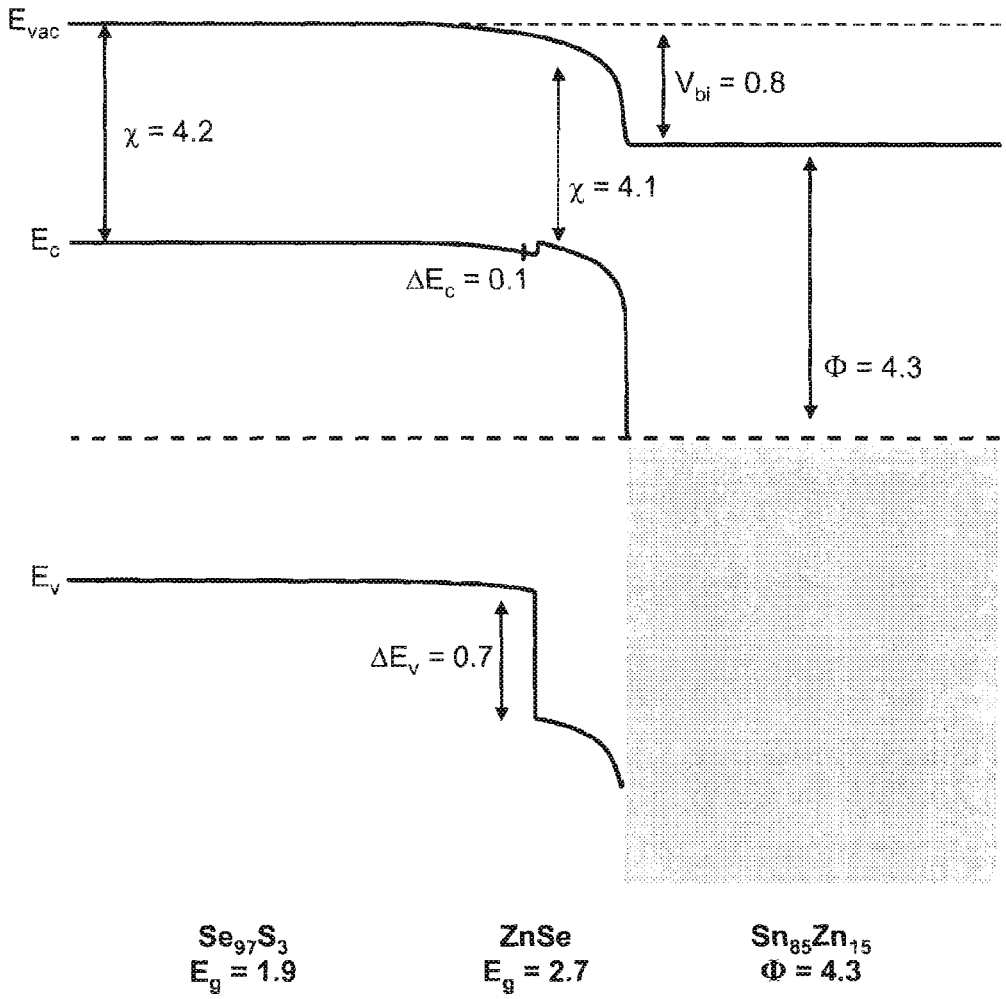
FIG. 5 is an illustration of a proposed band diagram of the $Se_{97}S_3/ZnSe/Sn_{85}Zn_{15}$ heterostructure (values in eV).

A preliminary band diagram of the proposed $Se_{97}S_3$/ZnSe/$Sn_{85}Zn_{15}$ heterostructure is shown in FIG. 5. The diagram is constructed by combining the observed change in local vacuum level (i.e. contact potential) by KPFM with band offsets and built-in voltage calculated by Anderson's model of heterostructures given the material's bandgap and electron affinity (20, 28). The band diagram clearly indicates how the large discontinuity in the valence band at the $Se_{97}S_3$/ZnSe interface would create a barrier to hole flow, and the estimated valence band discontinuity between $Se_{97}S_3$ and ZnSe of 0.7 eV is nearly equal to the observed built in voltage of 0.8 eV. There is expected to be negligible difference between ZnSe and a statistical $ZnS_{0.03}Se_{0.97}$ alloy in either the Raman spectrum (29) or electronic bandgap (30), and the effect of local composition fluctuations would be minimal.

Methods

Fabrication $Se_{97}S_3$ was synthesized from high purity elements (Alfa Aesar) using the standard melt quenching technique. Elements in the correct proportion were inserted into a quartz ampoule under inert atmosphere and then transferred to a vacuum line for additional purification by sublimation of volatile oxides (~2 hours at 190° C.). The ampoule was then sealed and inserted into a custom rocking furnace where it was slowly heated to 500° C. and mechanically rocked over night to ensure homogenization. The ampoule was then quenched in water, and the glassy compound was removed.

Preforms were fabricated by first milling semicircular slots into the outer diameter of a polyethersulfone (PSU) polymer tube with a Bridgeport endmill. Slot spacing and orientation was kept constant with a digital indexer set to rotate the PSU tube at specific angles. High purity wires of $Sn_{74}Pb_{26}$ and $Sn_{85}Zn_{15}$ at % ($Sn_{63}Pb_{37}$ and $Sn_{91}Zn_9$ wt %) from Indium Corporation (Utica, N.Y.) were cut in half lengthwise and tightly fitted into the milled slots. A thick film (~30 μm) of semiconductor was thermally evaporated onto a PSU substrate and then wrapped around the preform core so that the semiconductor and metal electrodes were touching. Additional layers of PSU were then wrapped around the devices to impart mechanical toughness. The resulting preform was fused into a single solid structure by heating under vacuum at 230° C. for 1 hour and then slowly cooled to room temperature. The completed preform (having dimensions 26 mm in diameter, 120 mm in length) was then taken to an optical draw tower where it was thermally drawn into approximately 35 meters of continuous device fiber (nominal diameter ~1 mm) at 260° C.

Characterization

Current-voltage measurements were performed with Keithley 6517a electrometer. Capacitance measurements were performed with an HP 4284a LCR meter at 20 hz and 50 mV swing voltage to include the effects of all potential long-lived trap states. Photocurrent was measured as a function of wavelength for monochromated light and normalized by the measured responsivity at 530 nm. The NEP at 530 nm was calculated from the responsivity and the photodiode noise (taken to be the reverse bias dark current). Samples for imaging and surface analysis were prepared by ion polishing with a JEOL cross-section polisher. Amplitude modulated KPFM was performed with an Omicron UHV VT-AFM (base pressure $<5\times10^{-10}$ Torr) equipped with a Kevin Probe control unit using a nanosensors Pt—Ir tip (nominal resonance ~75 kHz). Kelvin signal was run at the first overtone of cantilever resonance (~475 kHz) with an applied peak-to-peak voltage of 200 mV to minimize tip-induced band bending. The tip work function was calculated by determining the CPD between the tip and a clean polycrystalline gold surface, and the sample work function was calculated by the relation, $\Phi_{tip}-\Phi_{sample}$=CPD. Samples were cleaned in-situ by argon-ion sputtering. The observed contact potential for both metal electrodes is consistent with previous work function measurements (16) and the measured work function of the selenium semiconductor appears in the middle of its known bandgap, giving confidence that the surface is reasonably well prepared and representative of the device's electronic structure. Image analysis was performed with SPIP and Gwyddion. Scanning confocal Raman spectroscopy was performed with a Witec CRM 200 in a backscatter geometry. A 532 nm laser was used as the excitation source, and this was focused onto the sample with a 100×NA0.9 objective.

This new ability to synthesize specific materials in specific locations within thermally drawn fibers according to the invention represents a milestone in fiber processing and suggests that many more materials can be built into composite fibers than previously thought. Zinc selenide, for example, has many interesting optical and electronic properties (31), but its high melting temperature (1530° C.) previously precluded it from use in all types of thermal drawing. It is likely that other compound semiconductors may be incorporated into fibers with a similar method. One must simply identify materials that may be co-drawn together that could react to form a new composition. The present work shows that metal chalcogenide semiconductors can be synthesized during fiber drawing. Given recent advances in the areas of silicon- and germanium-based fibers, it is likely that compound semiconductors used in conventional microelectronics may also be incorporated into photonic or electronic fiber devices. The fabrication of rectifying devices within drawn fibers by synthesis of an interface compound itself is an important development and is reminiscent of the first recognition that metal silicides can substantially improve the repeatability and reliability of metal-silicon contacts that has revolutionized microelectronics (32). This new fiber photodiode exhibits a three-order-of-magnitude improvement in NEP over previous fiber photoconductor devices (14). Furthermore, the ability to form both Ohimc and rectifying junctions is important for creating a host of different, increasingly complex electronic circuits. The ability to create blocking junctions may also be useful in improving the performance of newly demonstrated fiber transistors (12), and this work should lay the groundwork for many new advances in the function of fiber devices on both the individual and array level.

The invention disclosed herein can be used to synthesize the following compounds among others:

ZnS, ZnSe, ZnTe, PbS, PbSe, PbTe, $In_2Se_3$, InSe, $CuInSe_2$, $Bi_2Se_3$, InAs, InGaAs, Si(x)Ge(1-x).

It is recognized that modifications and variations of the invention will be apparent to those of ordinary skill in the art and it is intended that all such modifications and variations be included within the scope of the appended claims.

REFERENCES

1. Russell P (2003) Photonic crystal fibers. *Science* 299(5605):358-362.
2. Abouraddy A F, et al. (2007) Towards multimaterial multifunctional fibres that see, hear, sense and communicate. *Nature Materials* 6(5):336-347.
3. Cerqueira S A (2010) Recent progress and novel applications of photonic crystal fibers. Rep. Prog. Phys. 73(2):21.
4. Tyagi H K, Schmidt M A, Sempere L P, & Russell P S J (2008) Optical properties of photonic crystal fiber with integral micron-sized Ge wire. *Optics Express* 16(22): 17227-17236.
5. Shapira O, et al. (2006) Surface-emitting fiber lasers. *Optics Express* 14(9):3929-3935.
6. Jackson B R, Sazio P J A, & Badding J V (2008) Single-crystal semiconductor wires integrated into microstructured optical fibers. *Advanced Materials* 20(6):1135-1140.
7. Sazio P J A, et al. (2006) Microstructured optical fibers as high-pressure microfluidic reactors. *Science* 311(5767): 1583-1586.
8. O'Connor B, Pipe K P, & Shtein M (2008) Fiber based organic photovoltaic devices. *Applied Physics Letters* 92(19):193306-1-193306-3.
9. Liu J W, Namboothiry M A G, & Carroll D L (2007) Fiber-based architectures for organic photovoltaics. *Applied Physics Letters* 90(6) 063501-1-063501-3.
10. Liu J W, Namboothiry M A G, & Carroll D L (2007) Optical geometries for fiber-based organic photovoltaics. *Applied Physics Letters* 90(13) 133515-1-133515-3.
11. Lee M R, et al. (2009) Solar Power Wires Based On Organic Photovoltaic Materials. *Science* 324(5924):232-235.
12. Danto S, et al. (2010) Fiber Field-Effect Device Via in Situ Channel Crystallization. *Advanced Materials* 22(37): 4162-4166.
13. Bayindir M, et al. (2005) Integrated fibres for self-monitored optical transport. *Nature Materials* 4(11):820-825.
14. Sorin F, et al. (2007) Multimaterial photodetecting fibers: a geometric and structural study. *Advanced Materials* 19(22):3872-3877.
15. Lide D R (2008) *CRC Handbook of Chemistry and Physics* (CRC Press, New York).
16. Orf N, Baikie I, Shapira O, & Fink Y (2009) Work Function Engineering in Low Temperature Alloys. *Applied Physics Letters* 94:1135041-113504-3.
17. Champness C H & Chan A (1985) Relation Between Barrier Height And Work Function in Contacts to Selenium. *J. Appl. Phys.* 57(10):4823-4825.
18. Sommerhalter C, Matthes T W, Glatzel T, Jager-Waldau A, & Lux-Steiner M C (1999) High-sensitivity quantitative Kelvin probe microscopy by noncontact ultra-high-vacuum atomic force microscopy. *Applied Physics Letters* 75(2):286-288.
19. Seth M P, Clifford C A, Green F M, & Gilmore I S (2005) An accurate semi-empirical equation for sputtering yields I: for argon ions. *Surface and Interface Analysis* 37(5):444-458.
20. Sze S & Ng K (2006) *Physics of Semiconductor Devices* (Wiley-Interscience) 3 Ed.
21. Williams R H & Polanco J I (1974) Electronic-Structure of Chalcogenide Solids—Photoemission Study of Ordered and Disordered Selenium and Tellurium. *Journal of Physics C-Solid State Physics* 7(15):2745-2759.
22. Schlaf R, Pettenkofer C, & Jaegermann W (1999) Band lineup of a SnS2/SnSe2/SnS2 semiconductor quantum well structure prepared by van der Waals epitaxy. *J. Appl. Phys.* 85(9):6550-6556.
23. Madelung O, Rossler U, & Schulz M (1998) (Springer, New York).
24. Bennouna A, Priol M, & Seignac A (1988) Experimental density of states of tin selenide measurement on thin-films. *Thin Solid Films* 164:69-73.
25. Chiang T C & Himpsel F J (2006) ZnSe. Electronic Structure of Solids: Photoemission Spectra and Related Data, Landolt-Bornstein Group III, eds Goldmann A & Koch E E (Springer Verlang, New York), Vol 23a, pp 81-84.
26. Nagata K, Ishibashi K, & Miyamoto Y (1981) Raman and Infrared-Spectra of Rhombohedral Selenium. *Japanese Journal of Applied Physics* 20(3):463-469.
27. Taylor W (1967) Raman Spectra of Cubic Zinc Selenide and Telluride. *Physics Letters A* 24(10):556-558.
28. Milnes A G & Feucht D L (1972) *Heterojunctions and Metal-Semiconductor Junctions* (Academic Press, New York).
29. Gupta P, Bhattacharyya D, Chaudhuri S, & Pal A K (1992) Preparation and Characterization of Polycrystalline Znsxse1-X Films Prepared by a 2-Zone Hot Wall Technique. *Thin Solid Films* 221(1-2):154-159.
30. Ebina A, Fukunaga E, & Takahash. T (1974) Variation with Composition of E0 and E0+ Delta-0 Gaps in $ZnS_xSe_{1-x}$ Alloys. *Physical Review B* 10(6):2495-2500.
31. Kale R B & Lokhande C D (2004) Room temperature deposition of ZnSe thin films by successive ionic layer adsorption and reaction (SILAR) method. *Mater. Res. Bull.* 39(12):1829-1839.
32. Zhang S-L & Ostling M (2003) Metal Silicides in CMOS Technology: Past, Present, and Future Trends. *Critical Reviews in Solid State and Materials Sciences* 28(1):1-129.

What is claimed is:

1. Fiber draw synthesis process comprising:

arranging reactants in the solid state in proximate domains within a fiber preform;

fluidizing the preform at a temperature below the melting temperature of the reactants; and drawing the fluidized preform into a fiber thereby bringing the reactants in the proximate domains into intimate contact with one another resulting in a chemical reaction between the reactants thereby synthesizing a compound within the fiber.

2. The process of claim 1 wherein the reactants may be dissolved or mixed in a host within the preform.

3. The process of claim 1 wherein the reactants are selenium and zinc.

4. The process of claim 1 wherein the preform includes slots for containing at least one of the reactants.

* * * * *